US012410993B2

(12) United States Patent
Fowler

(10) Patent No.: US 12,410,993 B2
(45) Date of Patent: Sep. 9, 2025

(54) MOBILE BALLISTICS AND PROJECTILE RESISTANT CRATE WITH TELESCOPING PROTECTIVE BALLISTIC RESISTANT PANELS AND REMOVABLE STORAGE CAGE

(71) Applicant: Clayton Erik Fowler, Newnan, GA (US)

(72) Inventor: Clayton Erik Fowler, Newnan, GA (US)

(73) Assignee: GOLDENEYE DEFENSE LLC, Newnan, GA (US)

( * ) Notice: Subject to any disclaimer, the term of this patent is extended or adjusted under 35 U.S.C. 154(b) by 186 days.

(21) Appl. No.: 17/834,591

(22) Filed: Jun. 7, 2022

(65) Prior Publication Data

US 2023/0392904 A1 Dec. 7, 2023

(51) Int. Cl.

| | |
|---|---|
| ***F41H 5/24*** | (2006.01) |
| ***B65D 88/00*** | (2006.01) |
| ***B65D 90/00*** | (2006.01) |
| ***E04B 1/344*** | (2006.01) |
| ***E04H 9/10*** | (2006.01) |
| ***F41H 5/013*** | (2006.01) |
| ***F41H 5/06*** | (2006.01) |

(52) U.S. Cl.

CPC ..... *F41H 5/24* (2013.01); *B65D 88/005* (2013.01); *B65D 90/0073* (2013.01); *F41H 5/013* (2013.01); *E04B 1/3445* (2013.01); *E04H 9/10* (2013.01); *F41H 5/06* (2013.01)

(58) Field of Classification Search

CPC ... F41H 5/24; F41H 5/013; F41H 5/06; B65D 88/005; B65D 90/0073; E04H 9/10; E04B 1/3445

See application file for complete search history.

(56) References Cited

U.S. PATENT DOCUMENTS 6,067,889 A * 5/2000 Brown ..... E04H 9/10 89/36.02

8,069,769 B2 12/2011 Carberry et al.

(Continued)

FOREIGN PATENT DOCUMENTS

DE 102011008896 A1 * 3/2012 ..... E04H 9/10

DE 102019105597 A1 * 9/2020

*Primary Examiner* — Omar F Hijaz

(74) *Attorney, Agent, or Firm* — CHRISTOPHER J CHAN IP LAW LLC

(57) ABSTRACT

Rapidly deployable, immediately activated Mobile Mission Kits are highly flexible armored protective apparatuses that can be used in countless environments and against various threat types and levels to protect people, infrastructure and equipment while giving end users unit dominance advantages through the ability to establish an extended and hardened perimeter with checkpoint options by interconnecting operative (Mobile Mission Kit) units that interlock, an internal structural mission cage that can accommodate necessary tactical gear, weapons, equipment and supplies for missions or emergency responses, offensive capabilities, and stopping intrusion efforts from adversarial groups or entities. The Mobile Mission Kit does not require assembly or construction to activate the protective barrier upon arrival, and would not require any tools or equipment to active barrier, interconnect units, deactivation, or prepare for extraction

4 Claims, 8 Drawing Sheets

(56) References Cited

U.S. PATENT DOCUMENTS

| | | | | |
|---|---|---|---|---|
| 8,418,595 | B1 | 4/2013 | Saucedo et al. | |
| 9,222,759 | B2 * | 12/2015 | White | F41H 5/08 |
| 9,360,281 | B1 | 6/2016 | De Gaglia | |
| 10,215,539 | B2 | 2/2019 | White et al. | |
| 10,619,978 | B1 | 4/2020 | Ackley et al. | |
| 10,753,711 | B2 | 8/2020 | Muth | |
| 11,073,361 | B1 * | 7/2021 | Grigsby | F41H 5/24 |
| 11,204,222 | B1 | 12/2021 | Boucher | |
| 11,280,588 | B1 * | 3/2022 | Esquilin-Mangual | F41H 5/24 |
| 2010/0043629 | A1 * | 2/2010 | Carberry | F41H 5/08 52/645 |
| 2011/0203451 | A1 * | 8/2011 | Turpin | F41H 5/24 89/917 |
| 2012/0168702 | A1 * | 7/2012 | Fromm | F41H 5/045 89/929 |
| 2014/0224793 | A1 * | 8/2014 | Downey | B65D 81/38 220/4.12 |
| 2016/0247372 | A1 * | 8/2016 | Sylvester | E05G 5/02 |
| 2018/0313074 | A1 * | 11/2018 | Brown | E04B 1/3445 |
| 2020/0018572 | A1 * | 1/2020 | Gonzales | F41H 5/24 |
| 2020/0284553 | A1 * | 9/2020 | Esquilin-Mangual | E04H 9/04 |
| 2020/0393216 | A1 | 12/2020 | Maji et al. | |
| 2023/0243625 | A1 | 8/2023 | Adrain | |
| 2023/0304774 | A1 * | 9/2023 | Adrain | B32B 27/12 |
| 2023/0408226 | A1 | 12/2023 | Giordano et al. | |

* cited by examiner

MOBILE BALLISTICS AND PROJECTILE RESISTANT CRATE WITH TELESCOPING PROTECTIVE BALLISTIC RESISTANT PANELS AND REMOVABLE STORAGE CAGE

RELATED APPLICATION

The present application claims priority to U.S. Provisional Ser. No. 63/197,800, filed Jun. 7, 2021, the contents of which are hereby incorporated herein by reference.

BACKGROUND

The invention, known as The Mobile Mission Kit, is comprised of a rapidly deployable protective barrier system that provides immediate protection against various threat types and levels, requires no assembly or construction, and can be used in numerous settings, scenarios and environments while providing users the ability to store and deploy mission or application critical gear supplies with the system, thereby fortifying their situational unit or team with unit dominance, resilience and an extended fortified protected perimeter.

SUMMARY

Mobile Mission Kits were designed to address rapid deployment and immediate protection challenges faced by military, law enforcement, security, and other first responder units during various situations that present various threat types and threat levels in urban, rural and other environments and surroundings, including interiors of buildings, structures and campuses, and requires no assembly, construction, or heavy equipment to activate the telescoping/articulating protective barrier. The design incorporates a self-contained ballistic and projectile resistant crate with an internal mission cage that includes/accommodates the telescoping/articulating ballistic, blast and projectile protective barrier, and can be equipped with (optional) storage compartments for gear, equipment and supplies deemed necessary for missions, applications and emergency response situations.

Mobile Mission Crates can be produced as a single mold structure, or using multiple panels used to create the top, bottom and sides of the crates. Mobile Mission Kits are designed to protect personnel, infrastructure, gear, equipment and integrates versatility, nimbleness, re-configurability, and the capability to interconnect Mobile Mission Kits to form an extended protective perimeter. Mobile Mission Kits present a more effective solution for immediate protection in numerous war zones, urban conflicts, riot & civil unrest, rapid shooter scenarios and other situations.

The design allows users to activate the telescoping/articulating protective barrier either manually via simple pull strap/lever, or can be deployed using an automated means like an internal motorized mechanism that would be located within the internal mission cage or external of the crate. This critical salient feature, like other exemplary features cited herein, is what differentiates the Mobile Mission Kit from other deployable protective barriers that are bulky, cumbersome, and do not provide immediate protection without considerable construction and assembly time. The protective telescoping/articulating barrier of the Mobile Mission Kit opens in seconds.

The Mobile Mission Kit comprises of an intelligent and highly effective flexible design at its core that allows end users to specify and/or select optional internal mission cage configuration(s) to accommodate necessary tools, gear, supplies and equipment they deem necessary for their missions, applications and responses, without compromising the design, core and/or genus of the system. This includes optional height, width and depth requirements, and many materials options specified by the user for their needs.

The self-contained protective crate possesses an built-in pallet configuration at its base, which allows for ease of moving, transport, unloading, positioning, and repositioning in the field/on-site. Users would have the option of ordering the system with heavy duty industrial casters; such as 204 shown in FIGS. 1, 2, 6 and & positioned on the pallet area of the crate for moving and positioning/repositioning into place at destination/locations. Additional hardware required for logistical needs can be easily added to the crate without infringing on the design or structure of the Mobile Mission Kit. Such hardware can include D-rings, logistics straps channels, airlift hardware, and other tackle required for multiple transportation modalities. Other portable or deployable protective barrier systems require internal, external or attachable winch or lifting equipment for setup and breakdown. Mobile Mission Kits do not require such equipment, and can be easily collapsed into their crate by a single person or multiple people.

While the Mobile Mission Kit is designed as a rapidly deployable protective barrier system that provides protection against blasts, ballistics and projectiles, it also serves as an intrusion barrier that denies physical line of sight by a threat, force or group, and can serve as an anti-climb/anti-scale barrier by a simple specification request of materials made by an end user(s). This can include the introduction of anti-scale/anti-climb fencing material(s) added to the panels of the telescoping/articulating barrier wall, and can be part of the crate for improved line of sight viewing by law enforcement, war fighters or other users.

Interconnecting units to create an operative protective perimeter or safe zone can include checkpoint locations throughout the Mobile Mission Kit perimeter by introducing a gateway/door compartment within the crate and internal mission cage compartment. This interior compartment can be equipped with detection technologies such as magnetometers, and/or detection technology used for detecting explosives, radiological or other WMD types. Checkpoint gates or doors can be equipped with a mantrap option for containing and stopping the forward advancement of a recognized offender or perpetrator without infringing or changing the basic core function and design of the system.

Offensive capabilities such as gun ports, such as 403 shown in FIGS. 4 7, and 8, within the panels of the telescoping protective barrier, and turrets for heavy tactical arms can be added to the top of the crate portion of the system without compromising or infringing on the core design and purpose of the units. Operative connection mechanisms that interconnect units can be specified by end users depending on their needs and operational environments.

Though designed as a rapidly deployable, immediately activated protective barrier system, customer specified variations could be produced for stationary applications while remaining true to the very basic design of a deployable crate, mission cage, and rapidly deployable protective barrier configuration/design that would not compromise or infringe on its purpose in any way.

The embodiments contained herein illustrate the operational components that enable the protective barrier, among others, to open and close in a telescoping/articulating manner. The Operating component that allows for the opening and closing of the barrier can be any mechanical hardware readily available. These, along with the internal mission cage, access doors and panels to the internal cage and protective barrier, and other features of the Mobile Mission Kit are illustrated in the embodiments herein.

Internal mission cages can be easily removed from the crate for inspection, repair of any areas of the mission cage, or to gain access for field reconfiguration of the mission cage, changing of protective barrier panels, or to add wiring channels, such as 306 shown in FIGS. 3, 5, 6, 7 and & and hardware for the introduction of post manufacturing detection and security technologies (as examples).

Figure 1:
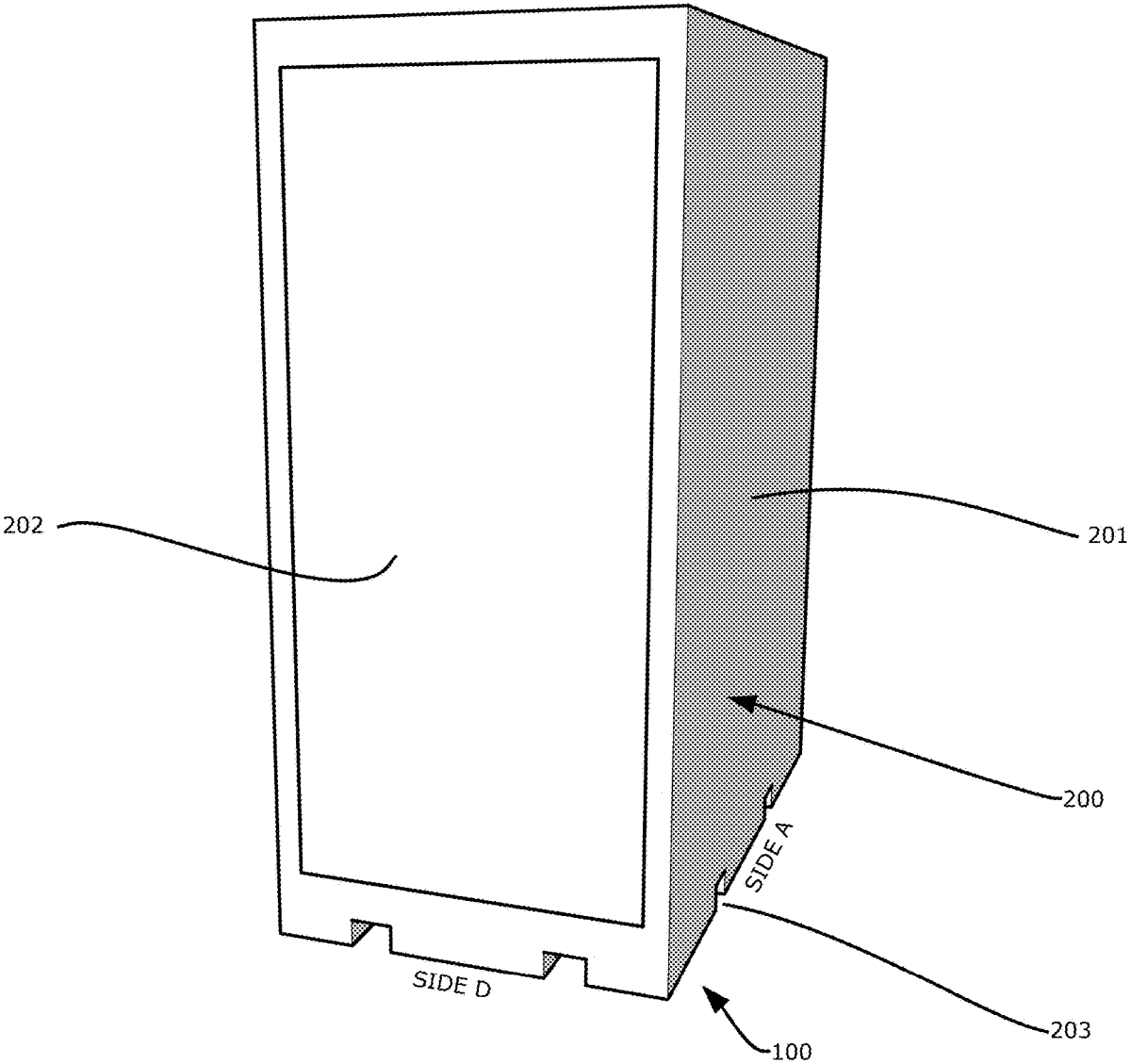
FIG. 1.
Figure 2:
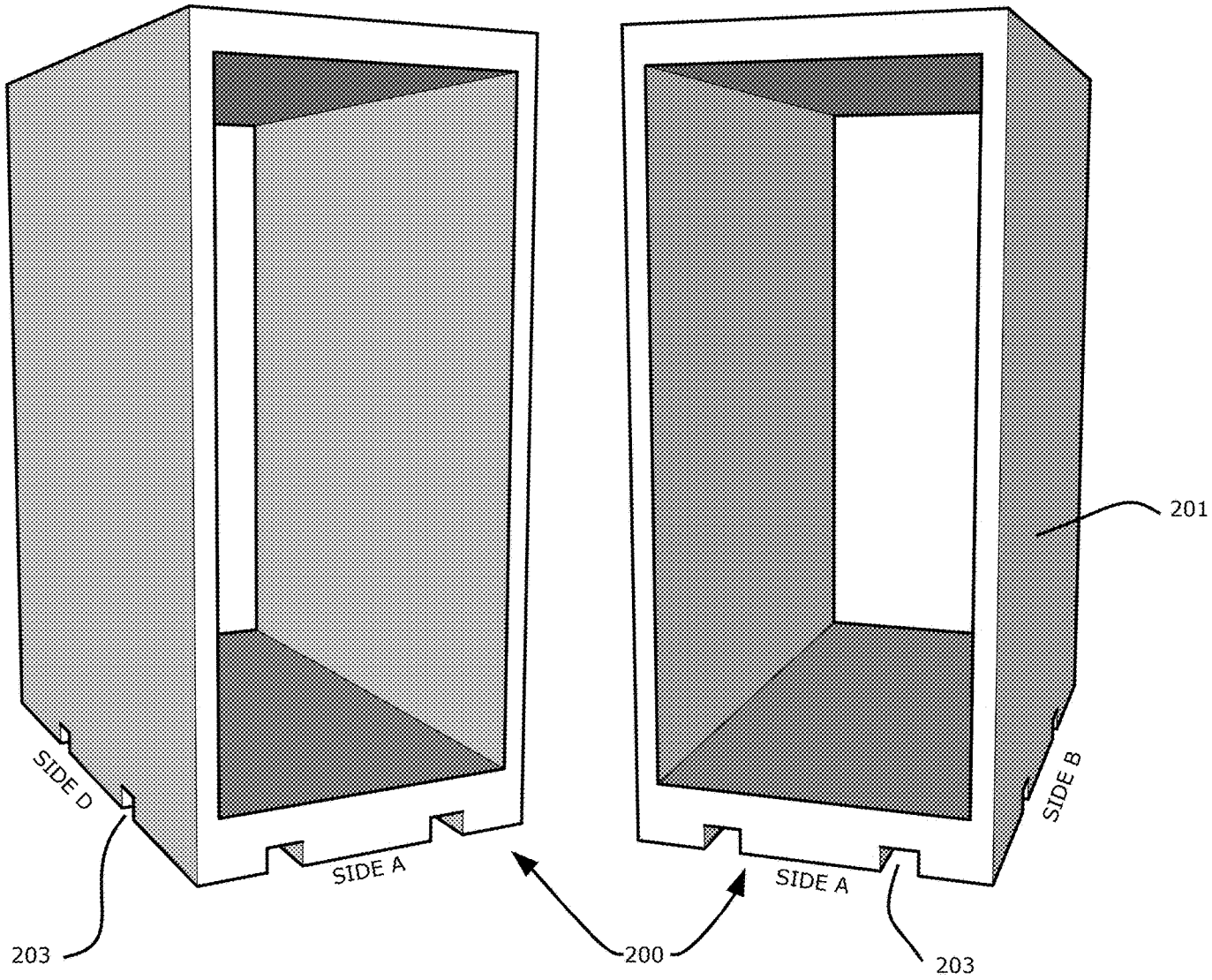
Figure 3:
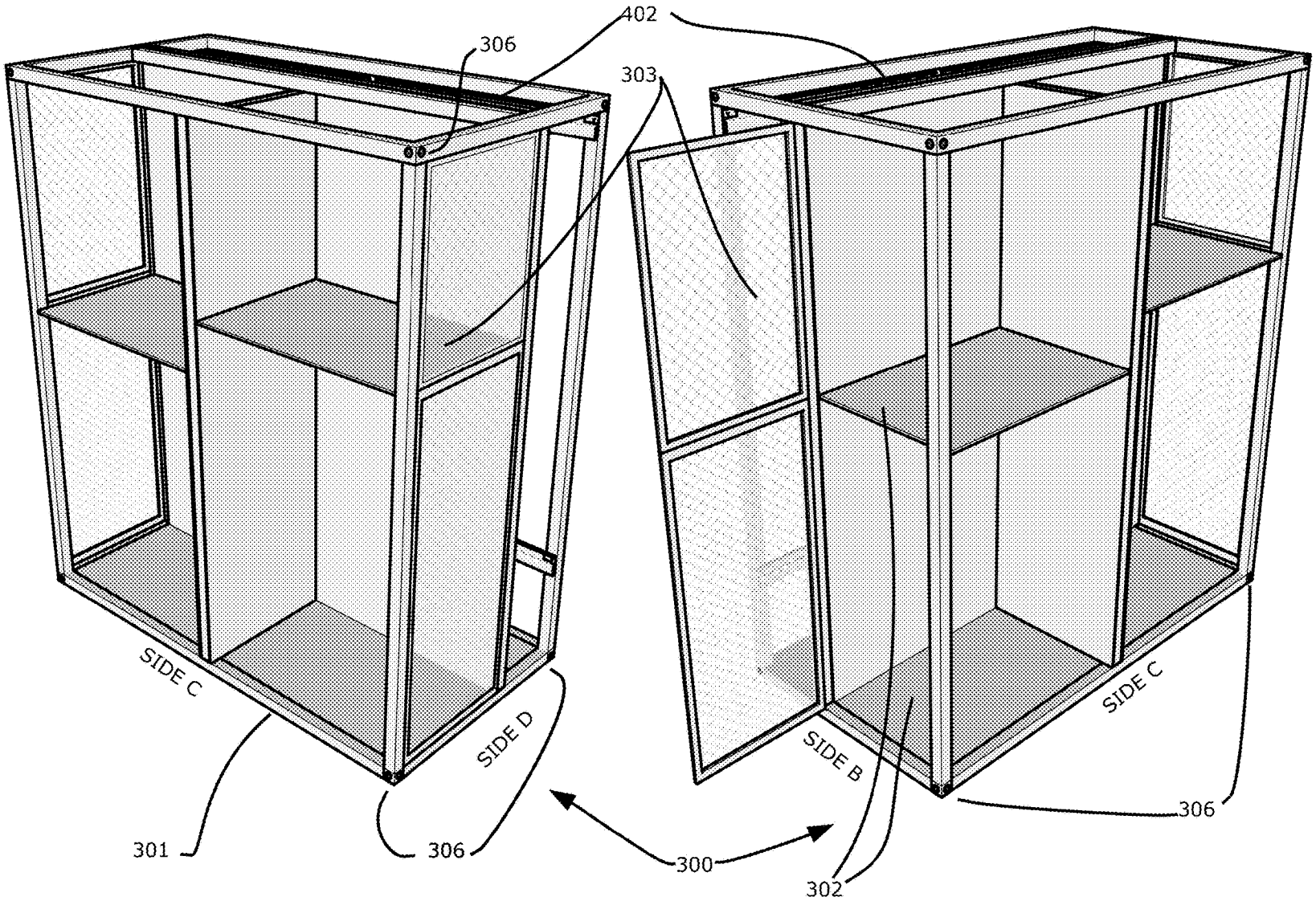
Figure 4:
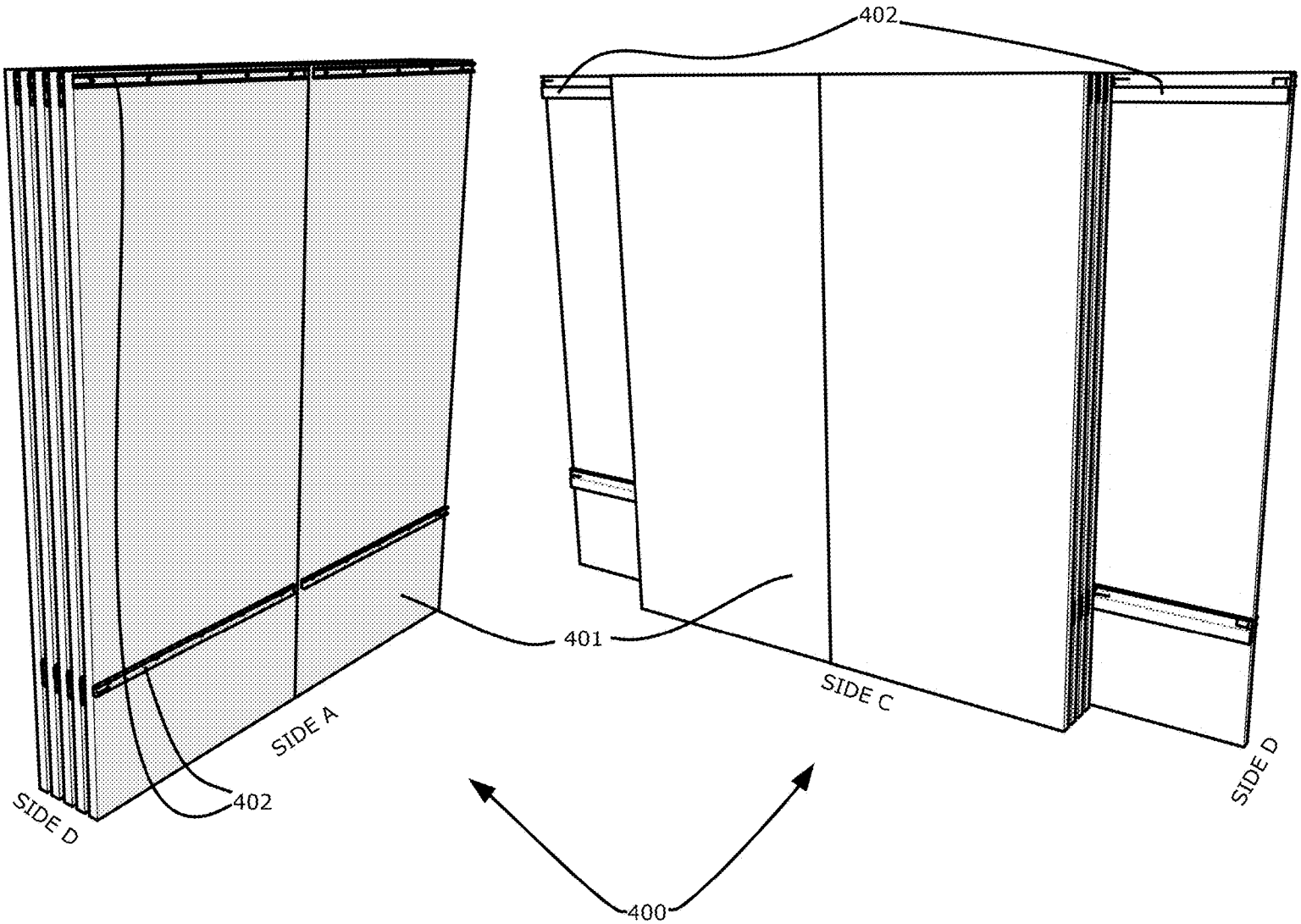
Figure 5:
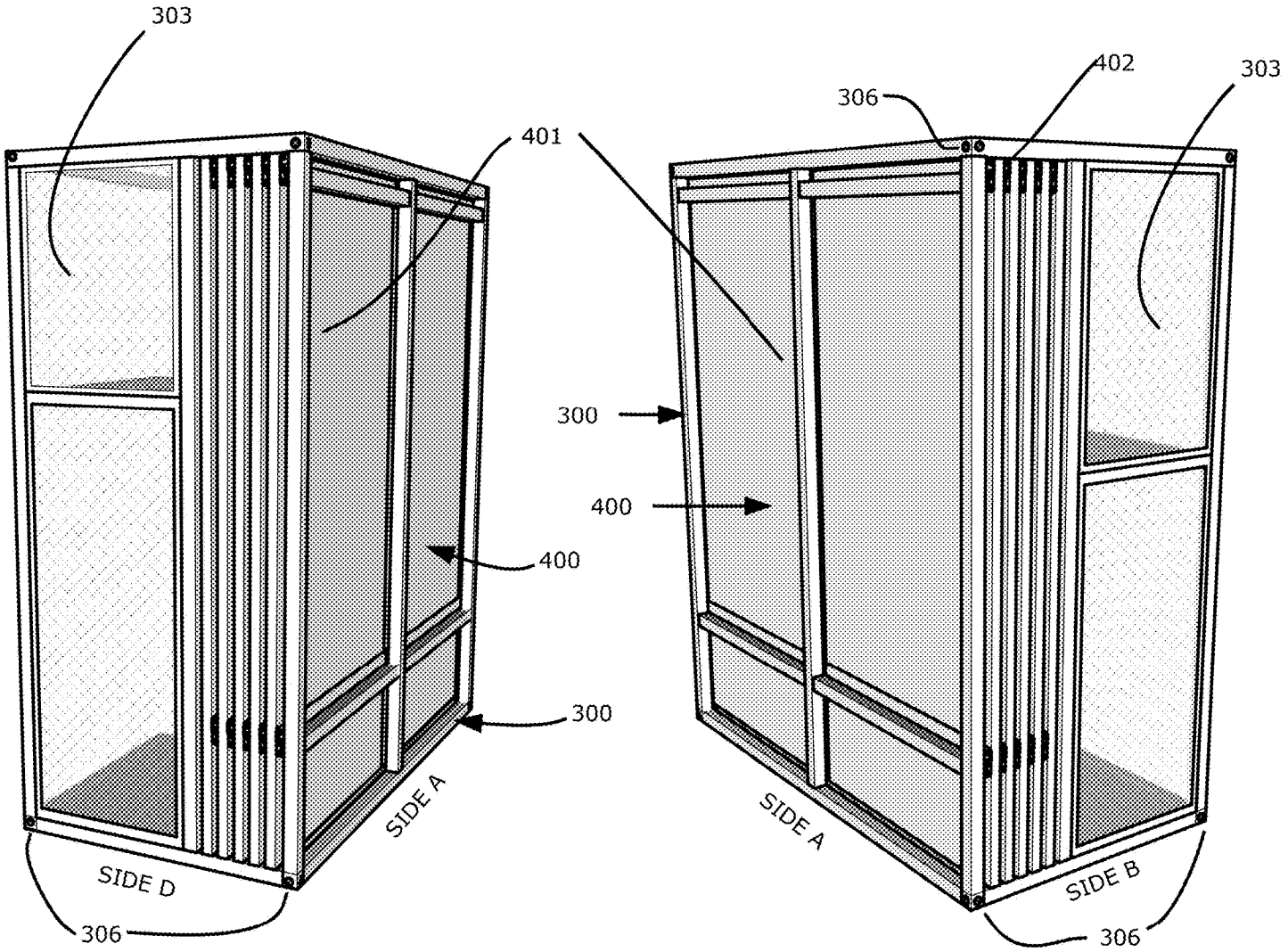
Figure 6:
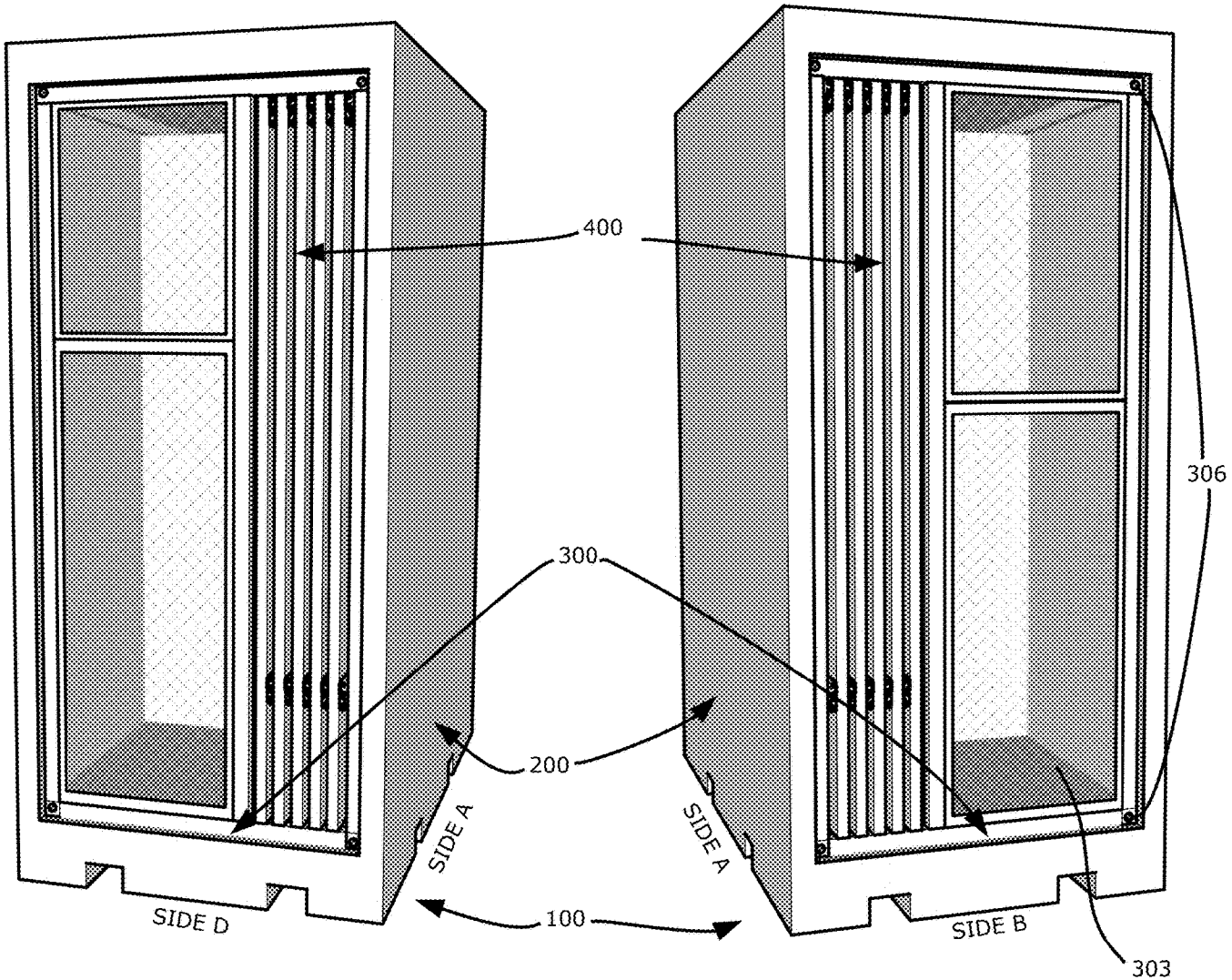

Depicts the Mobile Mission Kit (100) Crate (200) featuring sides "A" & D", side access door (202—Side "D"), and built-in pallet with forklift channels (203—length and depth view—Side "A" & "D" on drawing), made from any type of ballistic and projectile resistant materials (201), or other end user specified materials.

FIG. 2:

This representation illustrates the Mobile Mission Kit (100) Crate (200) with side door (202) removed, exposing the interior space of the crate (200), the material representation of the crate (201), sides "A", "B" & "D" of the crate, and built-in pallet forklift channels (203).

FIG. 3:

Represents the Mission Cage (300) of the Mobile Mission Kit (100), and removed from the Crate (200), its sides "B", "C" & "D", a representation of the mission cage material specified by end user (301), optional mission cage storage compartment (302), optional lockable storage compartment doors (303), and mechanical bracket hardware (402).

FIG. 4:

Illustrates multiple protective telescoping/articulating barrier panels (400) removed from the Mobile Mission Kit (100), the crate (200) and mission cage (300), its protective material specified by end user (401), functional mechanical brackets (402), and a view from sides "A", "C" & "D".

FIG. 5:

In this illustration, you are viewing the mission cage (300) removed from the Mobile Mission Kit (100) crate (200), with a view of the embodiment from sides "A", "B" & "D", depicting how the protective barrier panels (400) are positioned inside the mission cage (300), customer specified protective panel material (401), and optional storage compartment doors (303).

FIG. 6:

Represents from side views "B" & "D" how the Mobile Mission Kit (100) comprises of the crate (200), the mission cage (300), which accommodates the multiple telescoping/articulating protective barrier panels (400), with optional locking storage compartment doors (303), with a view of side "A", which represents the crate (200) side.

FIG. 7:

This embodiment, from side view "A" (or threat side), features the exemplary and salient workings of the Mobile Mission Kit (100) crate (200), the activated protective telescoping/articulating protective barrier panels (400), protective barrier panel mechanical brackets (402), and side view "A" of the incorporated forklift channels (203).

Figure 7:
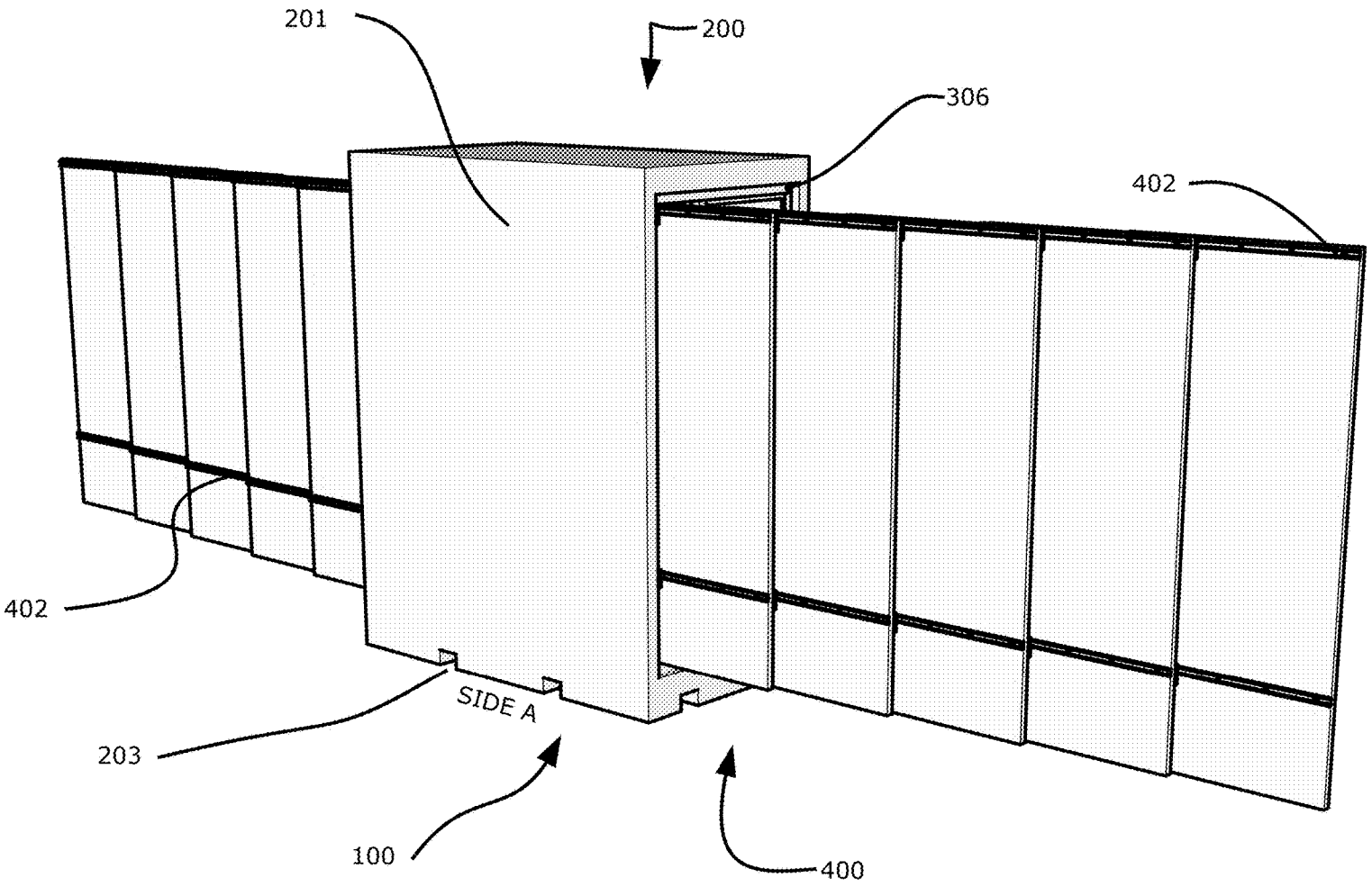
Figure 8:
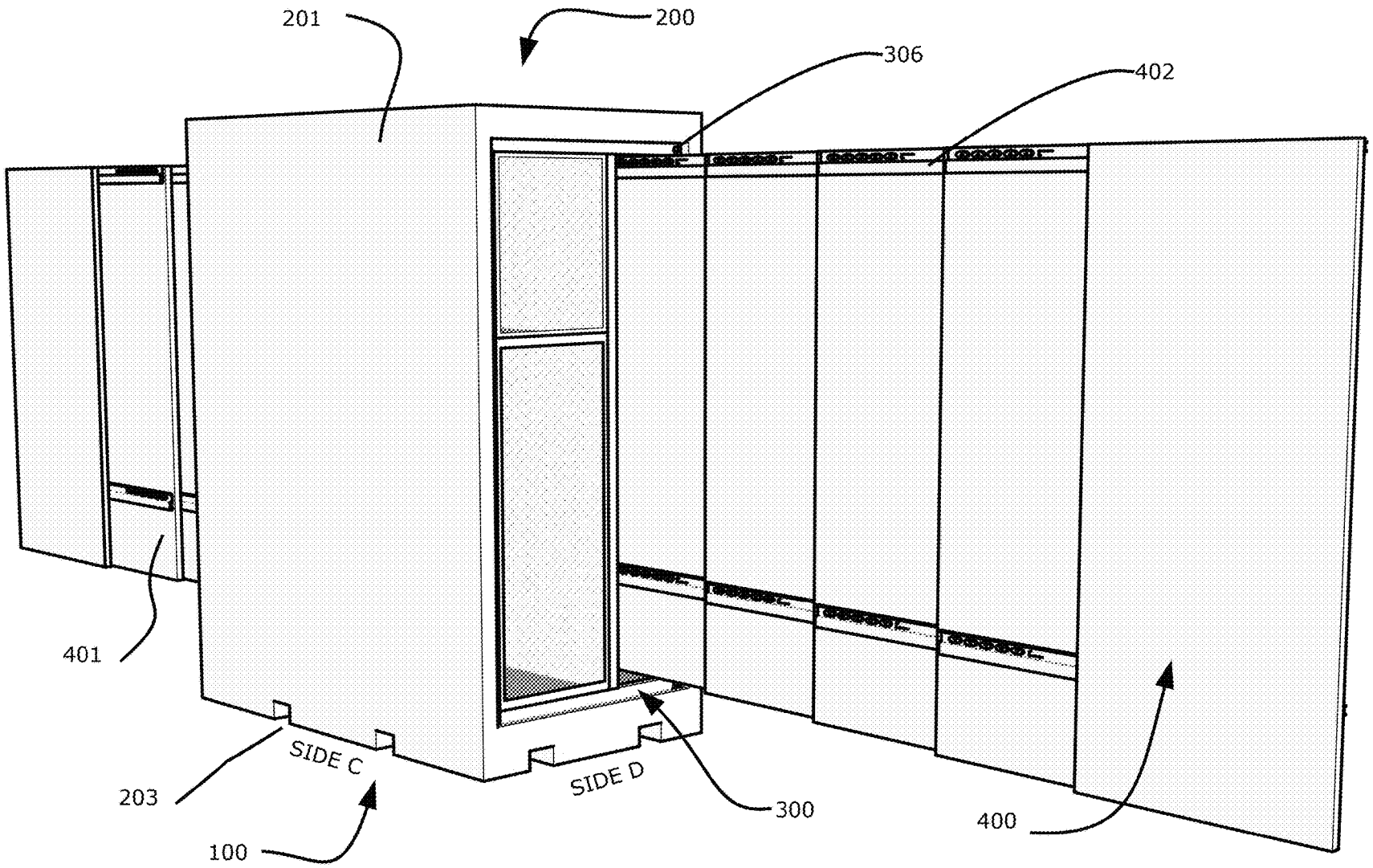

FIG. 8:

This figure represents the functional opposing side of FIG. 7 by representing the safe side of the Mobile Mission Kit (100) and incorporates side "C" & "D" to present the activated/deployed protective barrier panels (400), their mechanical hardware that allow them to open/close (402), the mission cage (300) which accommodates the protective barrier panels (400), the crate (200), the ballistic, blast, projectile or protective material (201) of the crate (200), and the forklift channels (203) for moving and repositioning the Mobile Mission Kit (100).

DETAILED DESCRIPTION

The drawings or embodiments contained herein represent the invention's components, inter-functional workings, assemblies and their purposes, and how each cohesively operates to create a unique, versatile, and rapidly deployable protective barrier system that delivers immediate protection for war fighters, law enforcement personnel, security and other first responders, and can be used to transport and deliver critical gear, equipment and supplies to forward or distressed locations of operation.

Critically important is the mention of end user dimensional/size requirements for the Mobile Mission Kit (100) crate (200), crate materials (201), cage (300), cage materials (301), optional cage storage compartment (302), telescoping/articulating panels (400), panel materials (401), mechanical brackets/hardware (402) and how the design and purpose of the design remain true and do not infringe on the inventions original design and basic functionality. The simplicity of the invention's design is what keeps the functionality true to its core purpose regardless of any end user specifications for specific materials, logistical, component or assembly functional hardware, addition of offensive capability hardware like gun ports, optional storage compartment with optional locking storage doors, or the introduction of industrial casters to the built-in pallet area of the crate.

The basic Mobile Mission Kit (100) design, its crate (200), internal mission cage (300), access door/panel (202), telescoping/articulating protective panels/barrier (400), and operating mechanical hardware/brackets (402) are at its core regardless of the material specified to manufacture each or any of these critical components comprised to produce the entirety of a Mobile Mission Kit (100).

The invention claimed is:

1. A system comprising:

a series of mobile crates, each crate configured to deploy independently from a pre-existing fixed structure, each crate comprising:

a pallet-type base with forklift channels, and a removable, non-collapsible internal cage with a compartmented storage area above the base, comprising a first compartment and a second compartment, wherein the first compartment is configured to accommodate a predefined amount of equipment prior to insertion of the cage within the crate, and wherein the second compartment holds a series of panels, separated from the predefined amount of equipment in the compartmented storage area, wherein each of the series of panels connects to an adjacent panel, and the series of panels deploys from the storage area by telescoping and/or articulating outward from the storage area to form an extended protective barrier, and wherein the extended protective barrier of a first crate in the series of crates connects to an extended protective barrier of a second crate in the series of crates to form an extended protected perimeter.

2. The system according to claim 1, wherein the extended protective barrier is secured within the internal cage during storage and transport.

3. The system according to claim 1, wherein each crate is treated with one or more protective materials to protect the crate from chemicals, water, corrosive materials, or UV rays.

4. The system according to claim 1, wherein each crate comprises one or more channels for cabling and wiring.

* * * * *